US006354872B1

(12) United States Patent
Lilienthal, II et al.

(10) Patent No.: US 6,354,872 B1
(45) Date of Patent: Mar. 12, 2002

(54) CABLE CONNECTORS WITH MODULAR SHIELDING

(75) Inventors: Peter F. Lilienthal, II, Princeton; Frederick H. Miller, Lebanon, both of NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/655,626

(22) Filed: Sep. 5, 2000

(51) Int. Cl.[7] ..... H01R 9/05; H01R 24/00

(52) U.S. Cl. ..... 439/578; 439/676

(58) Field of Search ..... 439/578, 501, 439/502, 503, 536, 460, 676, 941

(56) References Cited

U.S. PATENT DOCUMENTS 4,571,014 A * 2/1986 Robin et al. ..... 439/536
4,902,092 A * 2/1990 Grandy ..... 350/96.2
6,099,345 A * 8/2000 Milner et al. ..... 439/460
6,193,542 B1 * 2/2001 Marowsky et al. ..... 439/418

* cited by examiner

*Primary Examiner*—Brian Sircus
*Assistant Examiner*—Chandrika Prasad

(57) ABSTRACT

A modular type electrical connector comprises multiple unit connectors which again may be divided into multiple sub-units. Multiple number of unit connectors are attached together for the multiple wires of a cable making the modular type connector. The number of the unit connectors being used depends on the number of the wires of a cable. Each of the unit connectors is shielded with a highly conductive material. As a result, upon being attached together, each of the signal conducting paths, i.e. the wires of a cable, IDCs, contact blades, are separated from each other by a highly conductive coating material on the surface of the unit connectors thereby reducing near end cross talk of the modular type connector while providing flexibility in configuration and assembly.

21 Claims, 15 Drawing Sheets

CABLE CONNECTORS WITH MODULAR SHIELDING

BACKGROUND OF THE INVENTION

This invention relates to reducing electrical signal interference which arises in electrical connectors having closely spaced contacts. More particularly, the present invention relates to the reduction of cross talk induced by closely spaced contacts in electrical connectors.

High-speed data transmission cables are an integral part of computer networks and telecommunications systems. For example, a local area network (LAN) typically includes many individual computers and peripheral devices that communicate with one another through the high-speed data transmission cables. A LAN is typically implemented by physically connecting all of these devices with copper-conductor twisted wire pair LAN cables, the most common being an unshielded twisted wire pairs ("UTP") of LAN cable having eight wires. The eight-wire cable is usually specifically configured as four twisted wire pairs. Each of the four twisted-wire pairs functions as a transmission line which conveys a data signal through the LAN cable.

A cable is usually terminated within a length which can range from a few feet to about 50 feet. The terminated cables are assembled with electrical connectors such as 110 connectors, D8GS connectors, RJ45 connectors and RJ11 connectors for further connection with communication equipment.

Cross talk is a measure of signal interference between twisted wire pairs of a LAN cable. Cross talk exists when signaling current in one of the twisted wire pair induces corresponding currents in the other twisted wire pair of the cable. Near end cross talk ("NEXT") is a cross talk at the near end of a cable where the cable is terminated by an electrical connector such as a 110 connector, a D8GS connector, an RJ45 connector and an RJ11 connector. Maintaining a specified minimum level of NEXT at the electrical connector is important in order to maintain network work reliability.

Although electrical connectors such as 110 connectors, D8GS connectors, RJ45 connectors and RJ11 connectors have been used successfully, there is still room for improvement in the performance of the electrical connectors.

FIG. 1 shows a cable 100 having four twisted wire pairs. The cable 100 includes a jacket 111 and wires 120, 130, 140, 150, 160, 170, 180, 190 formed into twisted wire pairs. Insulating wire jackets 122, 132, 142, 152, 162, 172, 182, 192 of wires 120, 130, 140, 150, 160, 170, 180, 190, respectively, have different colors for identification. Each of pairs 120–130, 140–150, 160–170, 180–190 is twisted with different twist rates to reduce a signal interference between the pairs.

FIGS. 2A–2F show the components of conventional four piece type 110 connector 200 before assembly with the cable 100. The four piece type 110 connector 200 is designed to terminate a cable having four twisted pairs and to mate with a 110-type connecting block. The four piece type 110 connector 200 has a base member 202, a first housing member 204, a second housing member 206, a contact base 208 and a contact member 209 (for purposes of illustration and discussion, only the four top contacts are shown). The base member 202 receives the cable 100 and is fitted between the first housing member 204 and the second housing member 206. The base member 202 has channels 217*a*–217*d* constructed to receive wire pairs 120–130, 140–150, 160–170, 180–190 of the cable 100. For clarity in the drawings, only reference numerals for the first and last of comparable elements are shown. The channels 217*a*–217*d* of the base member 202 provide routing paths for the individual wire pairs 120–130, 140–150, 160–170, 180–190, 190, respectively. The base member 202 is also provided with insulation displacement contact ("IDC") grooves 218*a*–218*h* to receive the IDCs of the contact member 209. The contact base 208 and contact member 209 are assembled, and then inserted into the base member 202 in which the cable 100 is mounted. The base member 202, first housing member 204, second housing member 206 and contact base 208 are usually made from a non-conducting injection-molded plastic, such as polycarbonate, ABS, or PVC, while the contacts 209 are made from a conducting material, such as stamped phosphor bronze that is plated with nickel and gold. The four piece type 110 connector 200 is designed to terminate the cable 100 and mate with a 110-type connecting block.

Upon assembly, the wires of the four twisted wire pairs are placed in channels 217*a*–217*d* of the base member 202 and the isolation of each wires is limited to a certain degree because of the material of the base member 202, i.e. plastic. Furthermore, the assembling procedure of the conventional four piece type 110 connector 200 is not an easy task.

SUMMARY OF THE INVENTION

We have created a modular type electrical connector which is configured to receive and terminate the wires of a cable and to be connected to a female part of connecting block. The modular type connector comprises multiple unit connectors which again may be divided into multiple sub-units. Multiple number of unit connectors are attached together for the multiple wires of a cable. The number of the unit connectors being used depends on the number of the wires of a cable. A portion of the surface of the unit connectors is shielded with a highly conductive material. As a result, upon being attached together, each of the signal conducting paths, i.e. the wires of a cable, IDCs, contact blades, are separated from each other by a highly conductive coating material on the surface of the unit connectors thereby reducing near end cross talk of the modular type connector while providing flexibility in configuration and assembly.

In one embodiment, two unit connectors are used to make a modular type electrical connector terminating one pair of twisted wires. Each of the unit connectors has a contact adapted to mount a wire of a cable, and a housing adapted to receive the contact. The inside or the outside of the surfaces of the housing is coated with a highly conductive material, thereby shielding the conducting path of the unit connector. Since the modular type connector is built with multiple number of unit connectors, different numbers of the unit connectors are readily attached together depending on the number of wires of a cable to be assembled.

In another embodiment, a modular type electrical connector comprises a receiver unit, a contact unit, a base and a cover. The modular type connector has a cable with four twisted wire pairs. Each of the receiver unit and contact unit comprises four receiver members and four contact members, respectively. Each of the receiver members and contact members is designed to receive a pair of wires of a cable and shielded with a highly conductive material thereby reducing the interference between each pairs of the four twisted wire pairs.

Further features, aspects and advantages of the invention are set forth in or are apparent from the following description and drawings.

DETAILED DESCRIPTION

Figure 3:
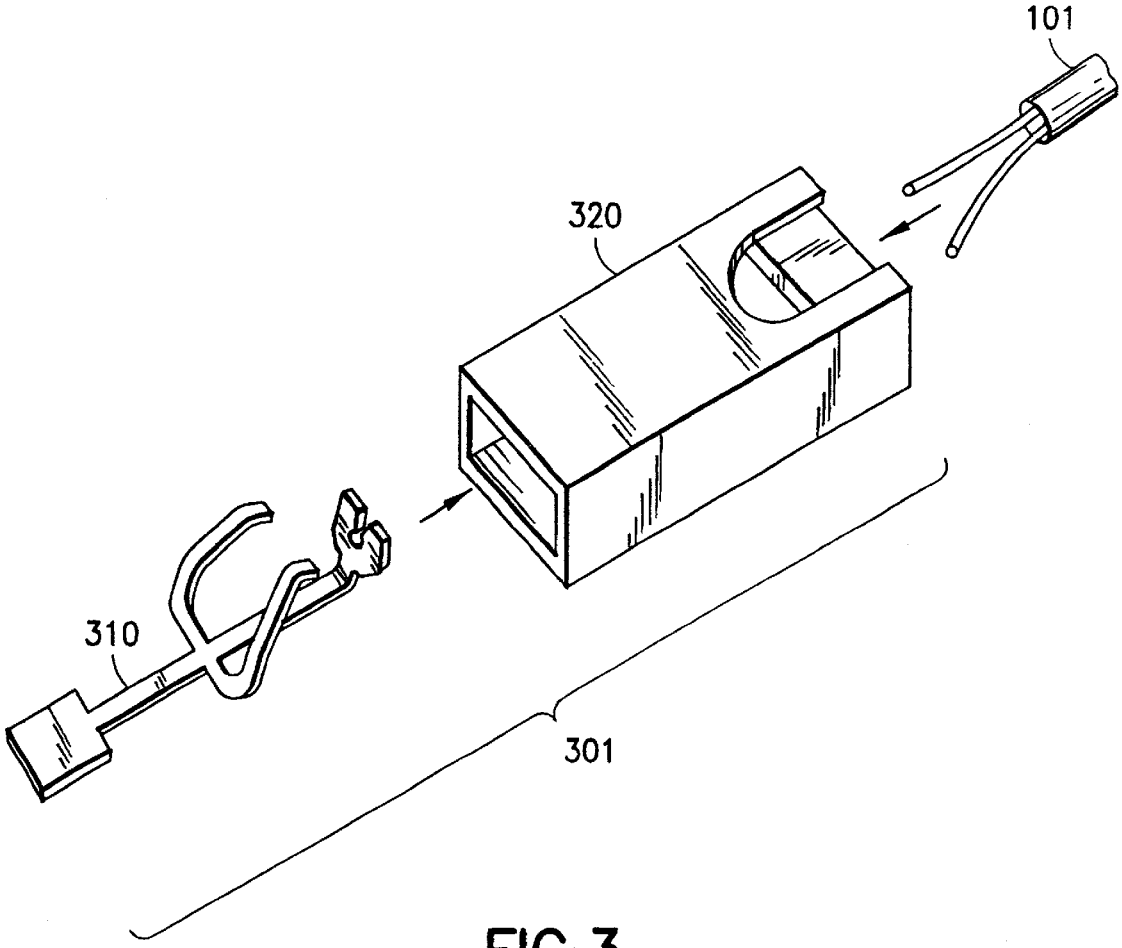
FIG. 3 depicts the component of a unit connector 301 which is a basic unit of a modular type connector 300 as a first embodiment.

FIG. 3 shows the components of a unit connector 301 before assembly which is a basic unit of a modular type connector 300 incorporating the invention. The unit connector 301 is made up of a contact 310 and a housing 320. The one side of the unit connector 301 is designed to receive and terminate one wire of a cable 101 while the other side mates with a connecting block (not shown). The contact 310 is made from a conducting material, such as, for example, stamped phosphor bronze plated with nickel and gold and the housing 320 is made from a non-conducting injection-molded plastic, such as polycarbonate, ABS, or PVC.

Figure 4:
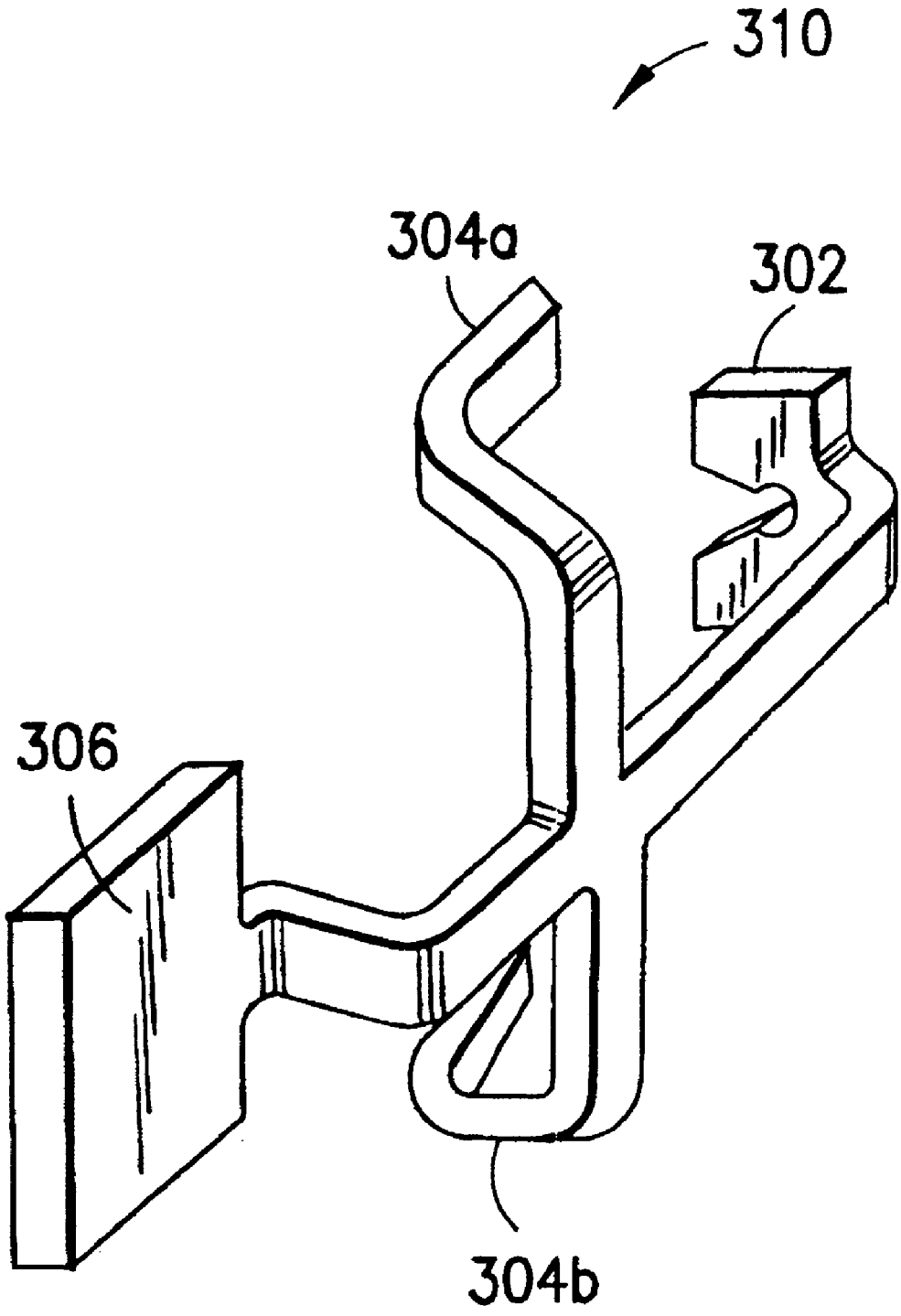
FIG. 4 is a detailed view of a contact 310.

FIG. 4 is a detailed view of an example contact 310. The contact 310 is designed to have an IDC 302 for connecting one wire of a cable and cutting the insulation of the wire. In another example, an extra IDC (not shown) may be designed serially to the first IDC 302 for relieving strain on the mounted wire. Alternatively, other strain relief techniques may be employed without affecting the merits of the invention. The contact 310 also has a retainer 304*a*–304*b* for fixing the contact inside the housing 320 when assembled. A contact blade 306 is constructed so as to mate with a female part of a connecting block (not shown).

Figure 5A:
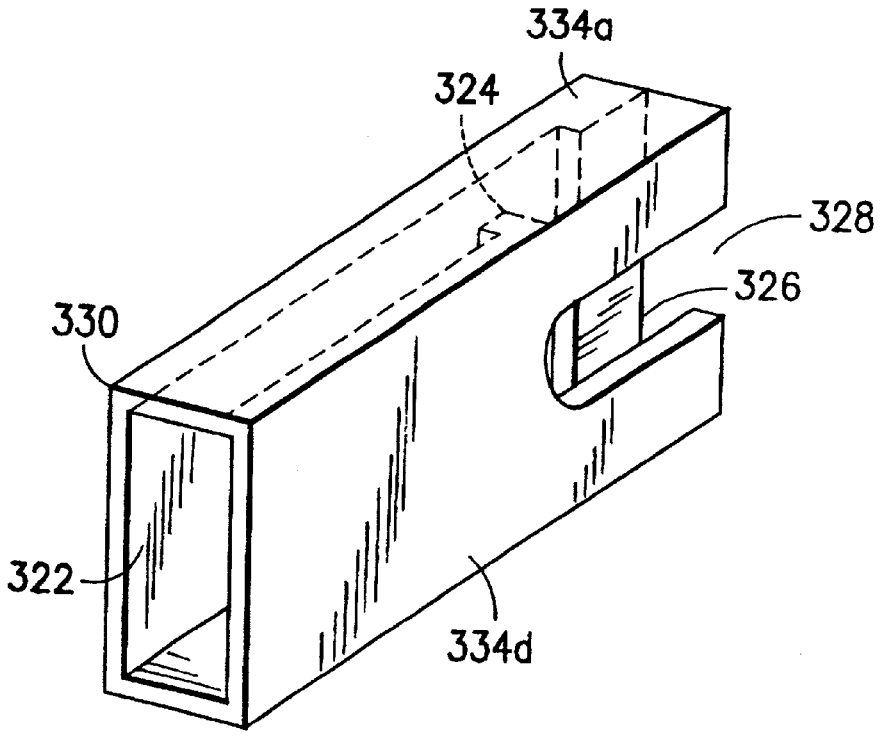
FIGS. 5A, 5B are a detailed view of a housing 320.
Figure 5B:
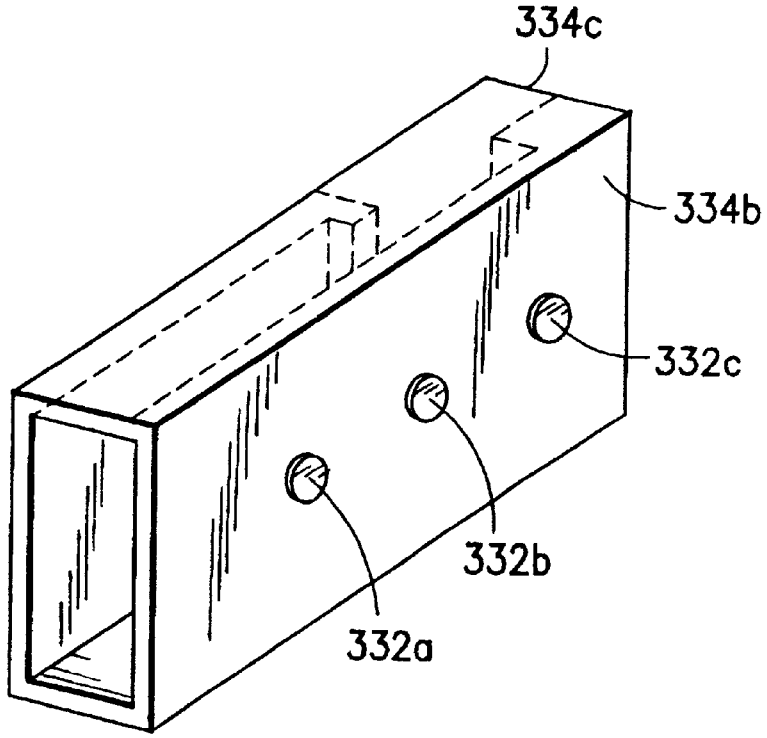

FIGS. 5A, 5B show a detailed view of two sides of the housing 320. Referring to FIG. 5A, the housing 320 has a cavity 322 for receiving the contact 310. The housing 320 has protrusions 324, 326 which stop and fix the retainer 304*a*–304*b* and the IDC 302 of the contact 310 when it is assembled. The housing 320 is also provided with an opening 328 where the IDC 302 of the contact 310 is exposed when the contact 310 is inserted into the housing 320. The opening 328 allows mounting of a wire of a cable into the IDC 302 and application of pressure to the IDC 302 to cut the insulation and connect the wire to form the gas tight seal. Three surfaces 334*a*–334*c* of the housing 320 are coated with a highly conductive material 330 such as aluminum. Alternatively, the housing 320 may be made of the highly conductive material 330. Of course, the housing 320 should be insulated from the wires. The conductive material, which coats the surfaces, shields the conducting path, (i.e. each of the wires and the contacts) when multiple numbers of the unit connectors are attached together in order to reduce near end cross talk in the modular type connector 300. The surface 334*d* containing the opening 328 need not be coated with the conductive material, since the surface 334*d* is attached to the coated surface 334*b* of another unit connector during assembly thereby providing the shielding for that surface. Coating all the surfaces allows an individual unit to be used alone or as both on edge or internal unit, whereas coating only three surfaces may in some cases prevent the unit from being used as an edge where unshielded side is exposed unless some further shielding is used for that surface. Alternatively, if other solid geometric shapes are used for the housing, such as tubes or cones, a portion of the surface need only be coated. Moreover, the coating may be an inner or outer portion of the housing irrespective of geometry. Various coating methods such as plating, sputtering, vacuum evaporation, glueing and pasting of a conductive film may be used. Alternatively, a conductive ink may also be printed to provide the shield.

FIG. 5B shows the other side of the example housing 320 of FIG. 5A. In this example, buttons 332*a*–332*c* are provided on one surface to attach the unit to another unit. The buttons 332*a*–332*c* need not be coated with conductive material. During assembly, the buttons 332*a*–332*c* contact a surface 334*d* of another unit and are used to join them together, for example, using ultrasonic welding. Alternatively, other joining methods may be used.

Figure 6:
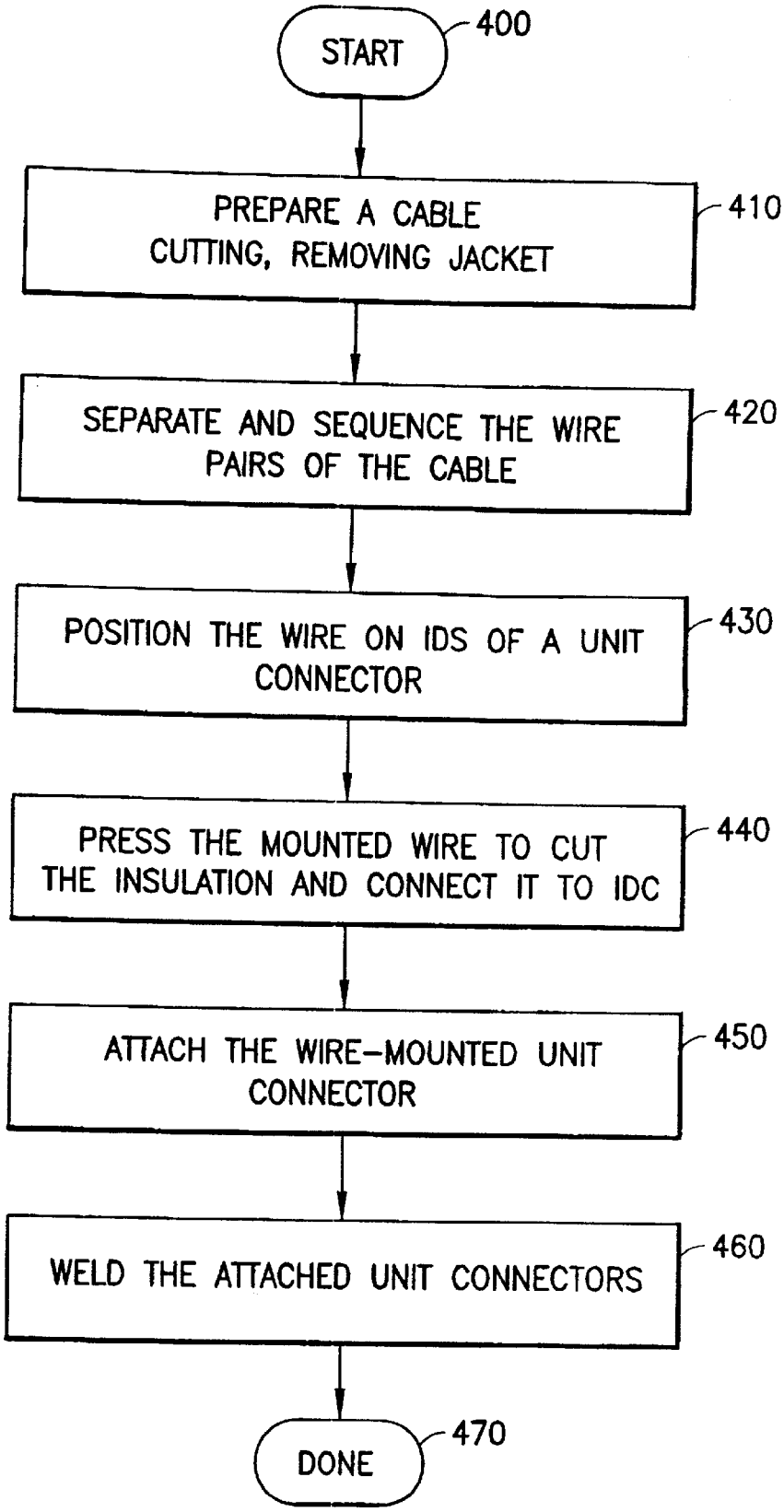
FIG. 6 is a flow chart of the assembly of the modular type connector 300 with a cable having a pair of wires.

FIG. 6 is a flow chart of one example of assembly method for the modular type connector 300. In this example, a cable with one twisted wire pair is used. Moreover, prior to assembly, the components of the unit connector 301, i.e. the contact 310 and the housing 320, have been pre-assembled in a factory.

To prepare the cable for assembly, the jacket is removed from the cable (step 410). The twisted wire pair of the cable is then separated and sequenced (step 420) to connect the wires to unit connectors. Once the wires of the cable are untwisted, one of the untwisted wires is positioned (i.e. mounted) on the IDC 302 of the contact 310 of the unit connector 301 (step 430). A pressure is then applied to the mounted wire to cut the insulation and connect the wire to the IDC 302 of the contact 310 (step 440). The other wire is connected in similar fashion to the other unit connector (steps 430 and 440).

The two wire-connected units are then attached together by aligning the buttons 332*a*–332*c* (step 450) and, for example, welding using ultrasonic welding techniques (step 460).

One advantage of this example embodiment incorporating the invention is that any number of individual units may be used, depending on the number of wire pairs in a cable without affecting the benefits achieved by the invention. For example, four unit connectors can be used for a cable with two twisted wire pairs, i.e. four wires. The individual units are attached to each using known techniques such as glue, mating clips, ultrasonic welding, solder, etc . . . The selection being dependent upon the particular model of modules used and irrelevant to understanding the invention. Alternatively, depending upon the number of individual wires in a cable, or the particular connector, the units can be attached together before they are connected to individual wires of a cable.

The above manual assembly process can similarly be performed on a fully automated assembly line. To do so, the plastic housings are bandolier together and fed into the automated assembly system machinery. The contacts are also formed on a web and feed into the same system. The system is made up of several functional elements, such as a machine vision, a robotic arm and an aligner, an welder, etc . . . The robotic arm attaches each unit connector to a separate wire in the twisted wire pairs. The aligner then aligns the connector parts. The welder then fuses the aligned units to each other. Machine vision may be used appropriately to assist the process. The automated machine process may be helpful to improve the performance of the assembled connectors by maintaining, for example, the twist rate of the wires with a predetermined value.

Figure 7:
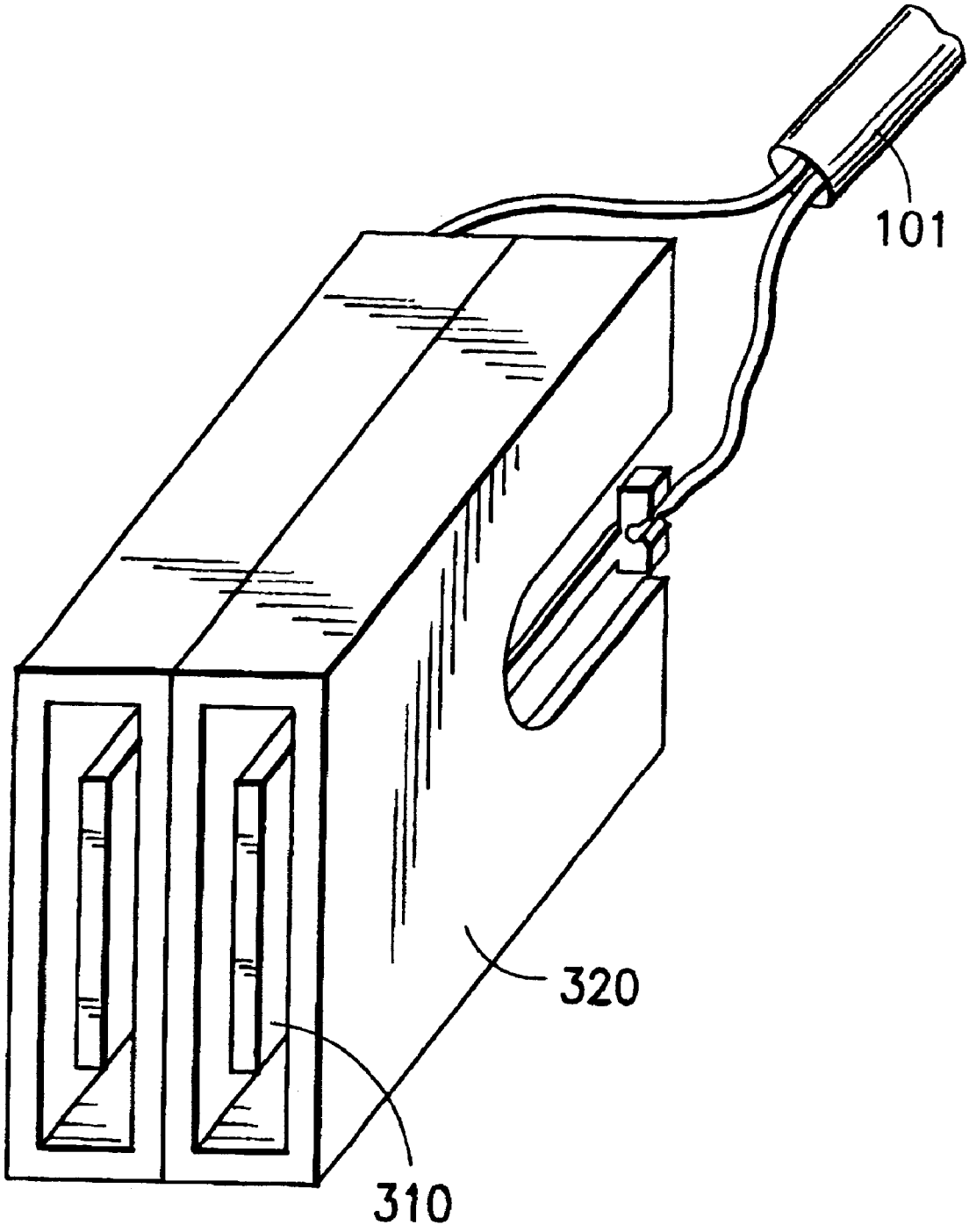
FIG. 7 is a view of fully assembled modular type connector 300.

FIG. 7 is an example of a completed modular type connector 300 having two unit connectors attached and welded together. Each of the two wires, IDCs and contact blades of the two unit connectors are separated from each other by a highly conductive coating material on the surface of the unit connectors. Grounding for the conducting surfaces of the unit connector is provided when the modular type connector 300 is connected to a connecting block (not shown). Alternatively, an additional grounding may be provided independently.

Another embodiment of the present invention is now described along with FIGS. 8–16.

FIGS. 8A–8E are the components of another example unit of modular type connector 500 before assembly. The modular type connector 500 is designed to terminate a cable having four twisted wire pairs and to mate with a connecting block such as 110 type. It should be understood that the connector 500 can be modified to terminate a cable having any number of twisted wire pairs, that is, 1, 2, 3 or more. The modular type connector 500 is made up of a base 510, a cover 520, a receiver unit 530 and a contact unit 540. For simplicity, reference numerals for only the first and last elements are shown although the other elements are of similar construction.

The base 510 has slots 512, 514 for mounting the cable 100. The base 510 also has channels 516*a*–516*d* for receiving the wire pairs 120–130, 140–150, 160–170, 180–190 making up the cable 100. The channels 516*a*–516*d* of the base 510 provide individual paths for the individual wire pairs. The cover 520 has channels 522*a*–522*d* which secure the individual twisted wire pairs upon assembly with the base 510.

The receiver unit 530 has, by way of example, four identical receiver members 530A, 530B, 530C, 530D. Advantageously, because of the modular nature, any number of receiver members can be attached together for any number of twisted wire pairs. Each of the receiver members 530A, 530B, 530C, 530D is designed to receive one of the four twisted wire pairs, on one side. Each of the receiver members 530A, 530B, 530C, 530D also receives a pair of IDCs in IDC grooves 534*a*–534*h*, located on the other side of the receiver units. As a result, the two wires in a member are not shielded from each other but they are shielded from another adjacent pairs. Each of the receiver members 530A, 530B, 530C, 530D is also typically made from a non-conducting injection-molded plastic, such as polycarbonate, ABS, or PVC. The outside of each of the receiver members 530A, 530B, 530C, 530D is shielded with a highly conductive material such as aluminum. Any other highly conductive materials such as gold or silver may be used for the shielding of the receiver unit 530A. The receiver members 530A, 530B, 530C, 530D are attached to each other, for example, by welding, such as by ultrasonic welding or using conductive adhesive bonding.

The contact unit 540, by way of example, contains four identical contact members 540A, 540B, 540C, 540D. Similar to the receiver unit 530 and because of the modular nature, any number of contact members can be attached together relatively easily to accommodate any number of twisted wire pairs. The IDCs of the contact members 540A, 540B, 540C, 540D are designed to mate with each of the IDC grooves 534*a*–534*h* of the receiver members 530A, 530B, 530C, 530D when assembled. The contact unit 540 mates with a 110-type connecting block. As with the receiver members 530A, 530B, 530C, 530D, the outside of each of the contact members 540A, 540B, 540C, 540D is shielded with a highly conductive material such as aluminum. Any other highly conductive materials such as gold or silver may be used for the shielding of the receiver unit 530A. The contact members 540A, 540B, 540C, 540D are also attached to each other, for example, by welding, such as by ultrasonic welding or using conductive adhesive bonding.

Figure 8A:
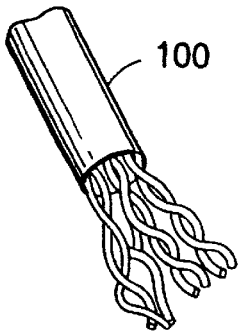
FIGS. 8A–8E depict the components of a modular type connector 500 as a second embodiment.
Figure 8B:
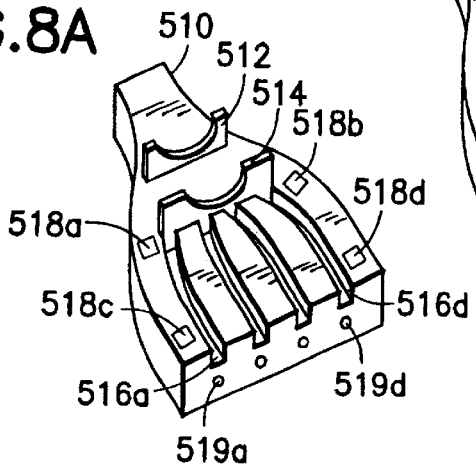
Figure 8C:
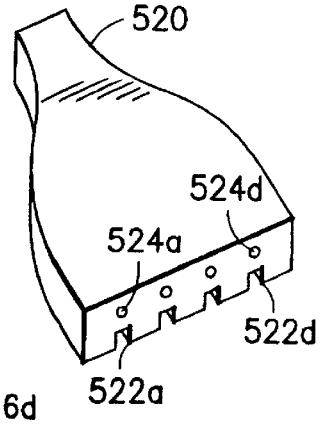
Figure 8D:
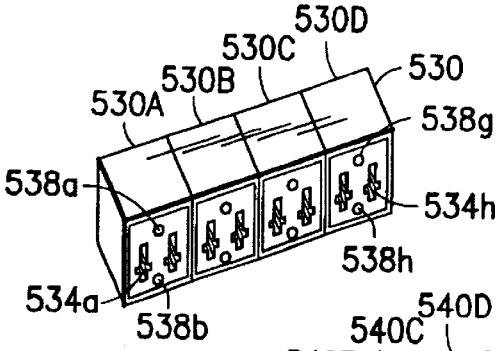
Figure 8E:
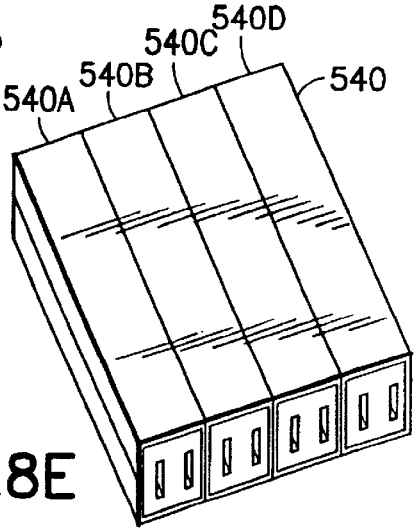
Figure 9A:
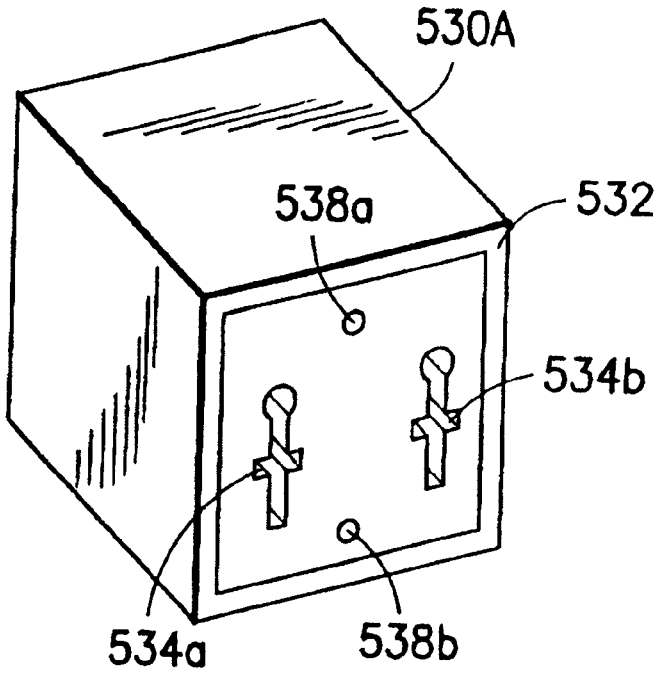
FIGS. 9A, 9B are both sides of a receiver member 530A for the receiver unit 530.
Figure 9B:
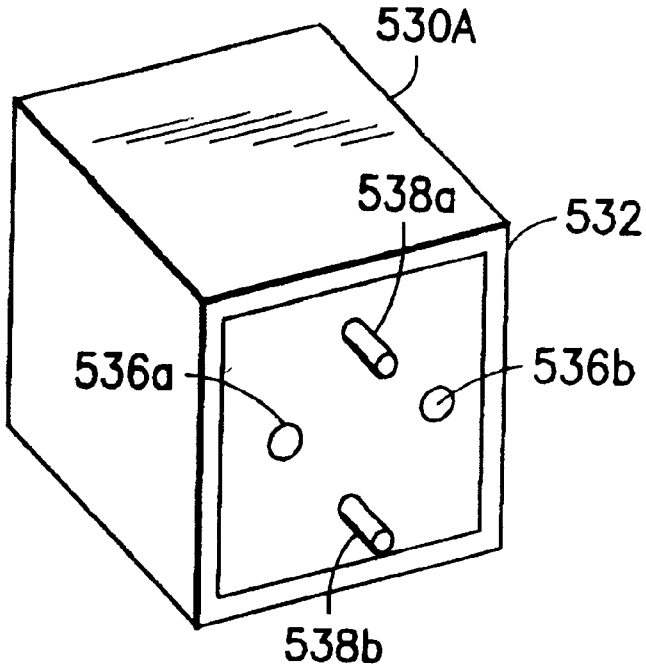
Figure 10A:
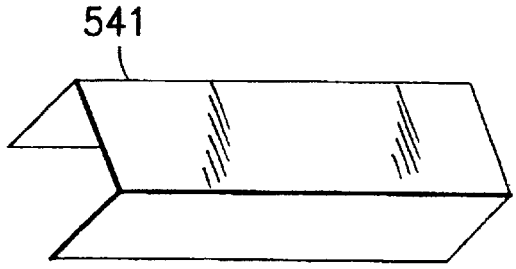
FIGS. 10A–10E show the components of the contact member 540A of the contact unit 540.
Figure 10B:
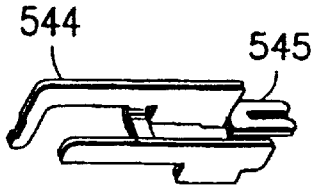
Figure 10C:
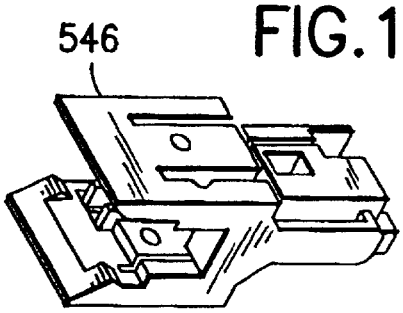
Figure 10D:
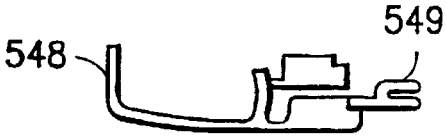
Figure 10E:
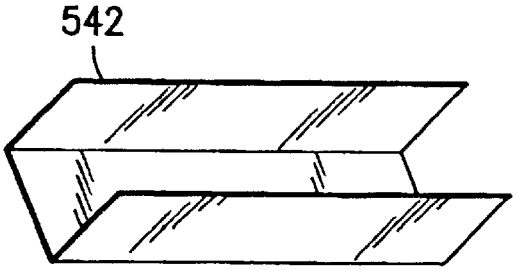

FIGS. 9A, 9B are both sides of a receiver member 530A for the receiver unit 530. FIG. 9A illustrates the side of the receiver member 530A where the contact unit 540 is mated as shown in FIG. 8D. The IDC grooves 534*a*–534*b* each receive a pair of the IDCs of the contact member 540A. The holes 538*a*–538*b* each receive a pair of pins (not shown) from the contact member 540A when assembled. FIG. 9B illustrates the side of the receiver member 530A where the individual twisted wire pairs are inserted. Holes 536*a*, 536*b* each receive one wire from the twisted wire pairs. Upstanding protrusions 538*a*, 538*b* mate with holes 519*a*, 524*a* in the base 510 and the cover 520, respectively.

FIGS. 10A–10E show the components of the contact member 540A of the contact unit 540. Contact member 540A comprises a top cover 541, a top contact 544, a bottom contact 548, a contact base 546 and a bottom cover 542. Each of the top contact 544 and bottom contact 548 has IDCs 545, 549, respectively. The contact base 546 also include a couple of pins (not shown) which will be inserted into the holes 538*a*–538*b* of the receiver unit 530 when assembled. The top cover 541 and bottom cover 542 are made from a highly conductive material such as aluminum. Alternatively, any other conductive materials such as gold or silver are used for the covers 541, 542.

Figure 11:
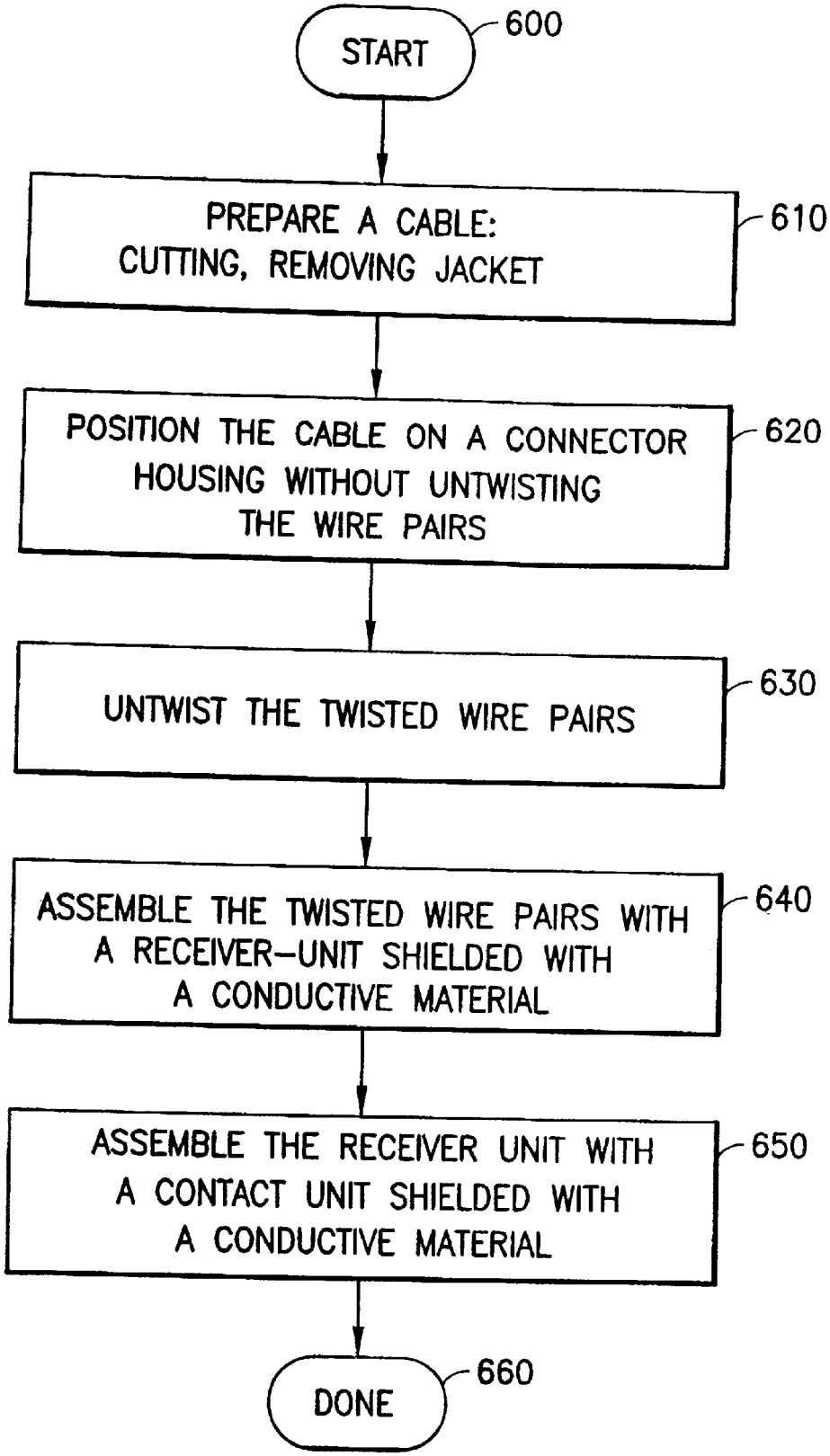
FIG. 11 is a flow chart of the assembly of the modular type connector 500.

FIG. 11 is a flow chart for assembly of the example modular type connector 500.

Figure 1:
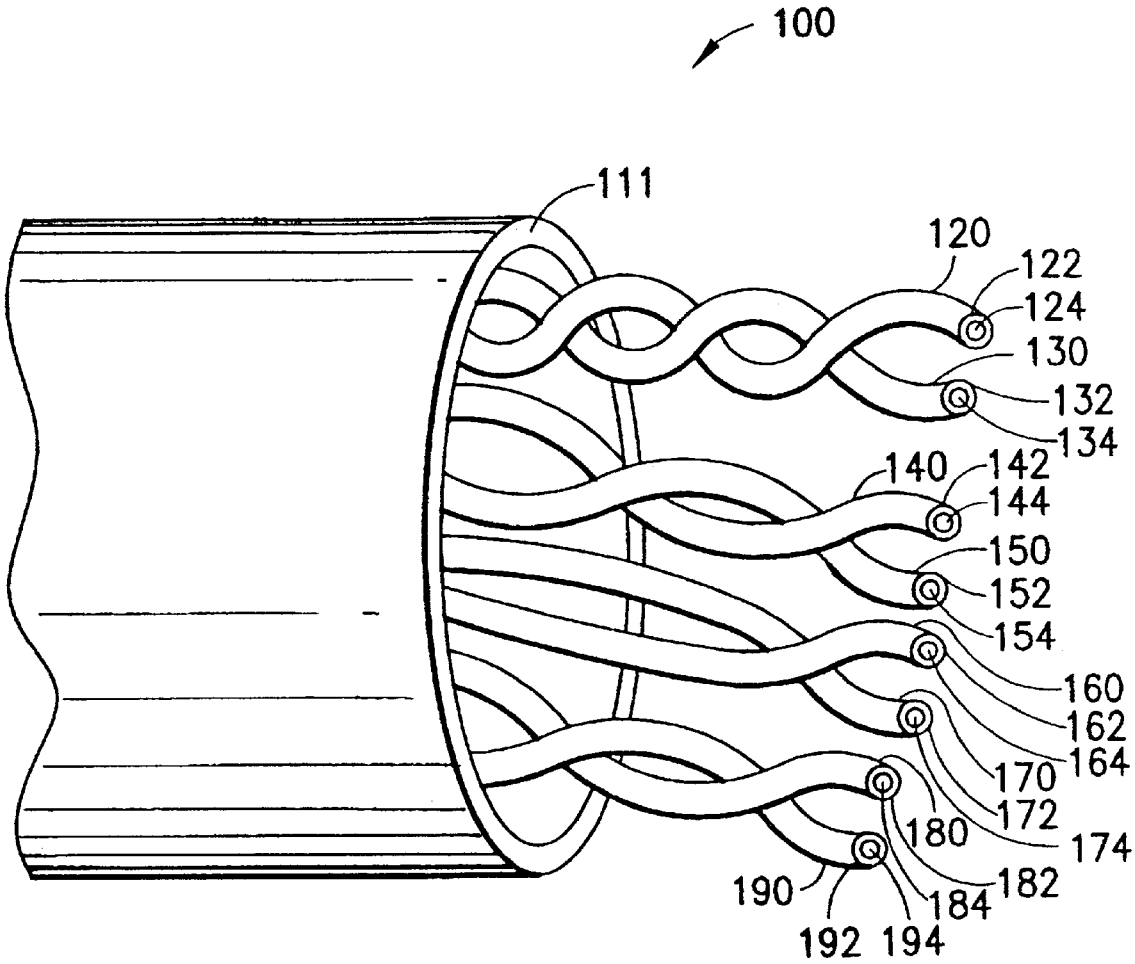
FIG. 1 is a view of cable 100 having four twisted wire pairs.
Figures 2A, 2B, 2C, 2D, 2E, 2F:
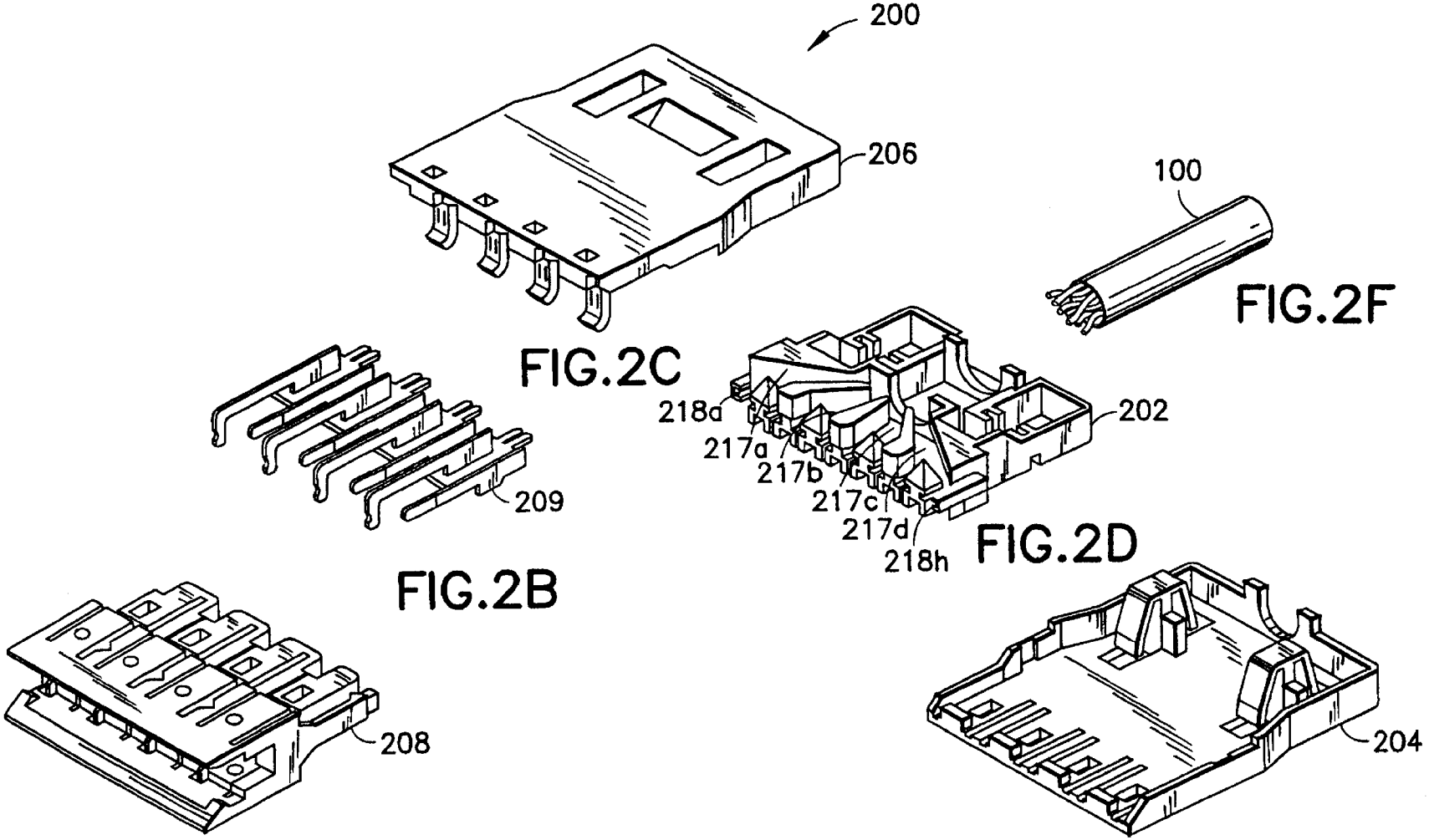
FIGS. 2A–2F depict the components of four piece type 110 connector 200.

A predetermined length of cable 100, as shown in FIG. 1, is uncoiled from a reel and cut (step 610). The cable 100 is prepared by removing the jacket 111 from an end of the cable 100 to expose the twisted wire pairs 120–130, 140–150, 160–170, 180–190 making up the cable 100.

The cable 100 is positioned on the base 510 of the modular type connector 500 (step 620). Without untwisting each of twisted wire, the individual wires are then sequenced according to a predetermined color sequence, and each of the twisted wire pairs is placed in one of the channels 516*a*–516*d* of the modular type connector 500. As a result, the twist rates of the twisted wire pairs are maintained. Subsequently, the cover 520 for the base 510 affixed to the top of the base 510.

The exposed portion of the twisted wire pairs are then untwisted (step 630).

The untwisted portion of the twisted wire pairs are then inserted into the receiver unit 530. Subsequently, the end of the wires are trimmed and bent down so that each of the wires are inserted into the IDC grooves 534*a*–534*h* and fixed thereon (step 640). The contact unit 540 is then inserted into the receiver unit 530 by inserting the IDCs and pins of the contact unit 540 into the IDC grooves and holes of the receiver unit 530. (step 650) As a result, the insulation of the individual wires are terminated by the IDCs of the contact unit 540.

FIGS. 12–16 are sequential views of a connector incorporating the invention at various stages of assembly.

Figure 12:
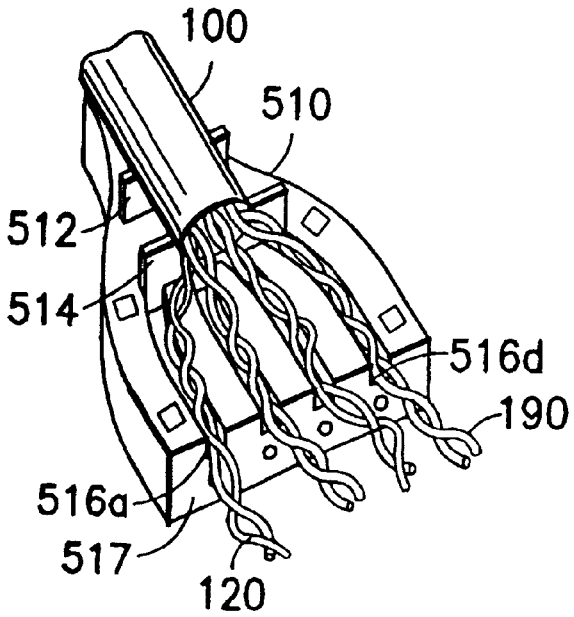
FIG. 12 shows a cable 100 positioned on a base 510.

FIG. 12 shows a cable 100 positioned on a base 510. The cable 100 is placed on a slot 512 and the end of the cable jacket 111 ends at a slot 514 in the base 510. Starting from the slot 514, the twisted wire pairs are placed into one of channels 516*a*–516*d* of the base 510. The ends of the twisted wire pairs are kept large enough so as to extend beyond the front surface 517 of the base 510. The cover 520 then affixed to the top of the base member 510.

Figure 13:
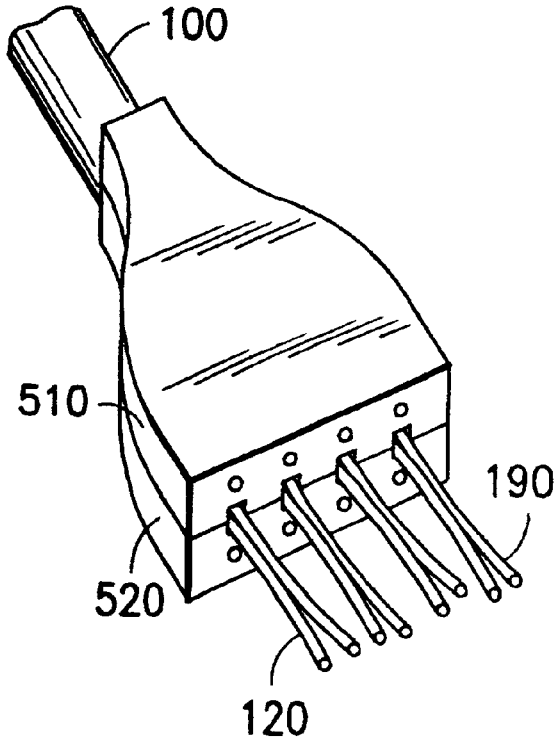
FIG. 13 is a view of the sub-assembly of FIG. 12 showing the wire pairs 120–130, 140–150, 160–170, 180–190 untwisted and sequenced.

FIG. 13 is a view of the sub-assembly of the base 510, the cover 520 and the cable 100 showing the twisted wire pairs 120–130, 140–150, 160–170, 180–190 untwisted and sequenced.

Figure 14:
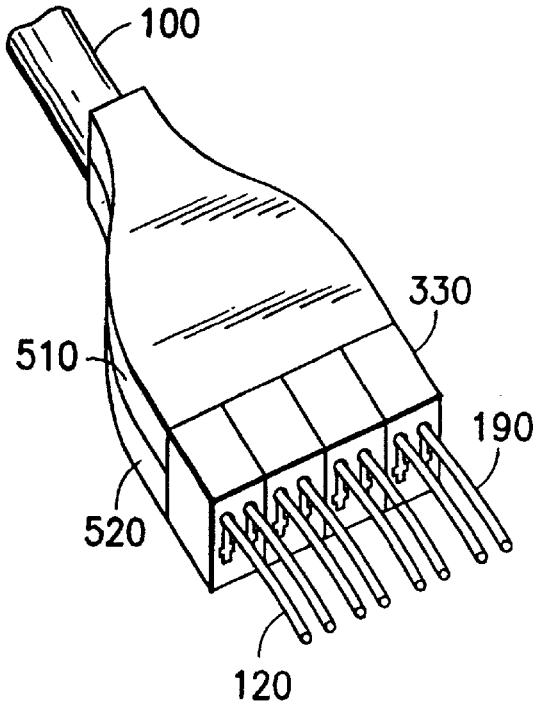
FIG. 14 shows the sub-assembly of receiver unit 530 and the sub-assembly of FIG. 13 with the ends of the wires not trimmed.
Figure 15:
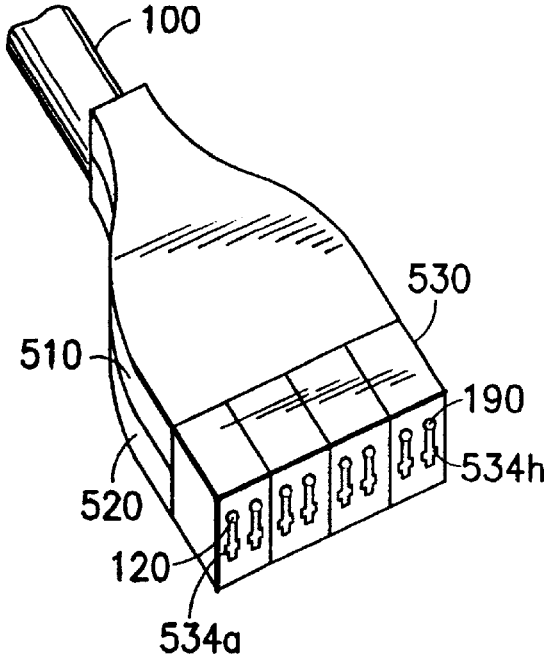
FIG. 15 shows the sub-assembly of FIG. 14 with the ends of wires have been trimmed and inserted into the IDC grooves 534*a*–534*h* of the receiver unit 530.

The sub-assembly of FIG. 13 is now connected to the receiver unit. The wires of the sub-assembly of FIG. 13 are inserted into the corresponding holes 536*a*–536*h* in the receiver unit 530. The protrusions 538*a*–538*h* of the receiver unit 530 are mated to corresponding holes 519*a*–519*d* of the base 510 and 524*a*–524*d* of the cover 520, respectively. FIG. 14 shows the sub-assembly of the receiver unit 530 and the sub-assembly of FIG. 13 with the ends of the wires not trimmed. The ends of each of the wires are then trimmed and inserted into the IDC grooves 534*a*–534*h* of the receiver unit 530. FIG. 15 shows the sub-assembly of FIG. 14 with the ends of wires have been trimmed and inserted into the IDC grooves 534*a*–534*h* of the receiver unit 530.

The contact unit 540 is now connected to the sub-assembly of FIG. 15 by inserting the IDCs (not shown) of the contact unit 540 into the IDC grooves 534*a*–534*h* of the receiver unit 530. An appropriate supporting techniques may be used to hold the connection between the receiver unit 530 and the contact unit 540.

Figure 16:
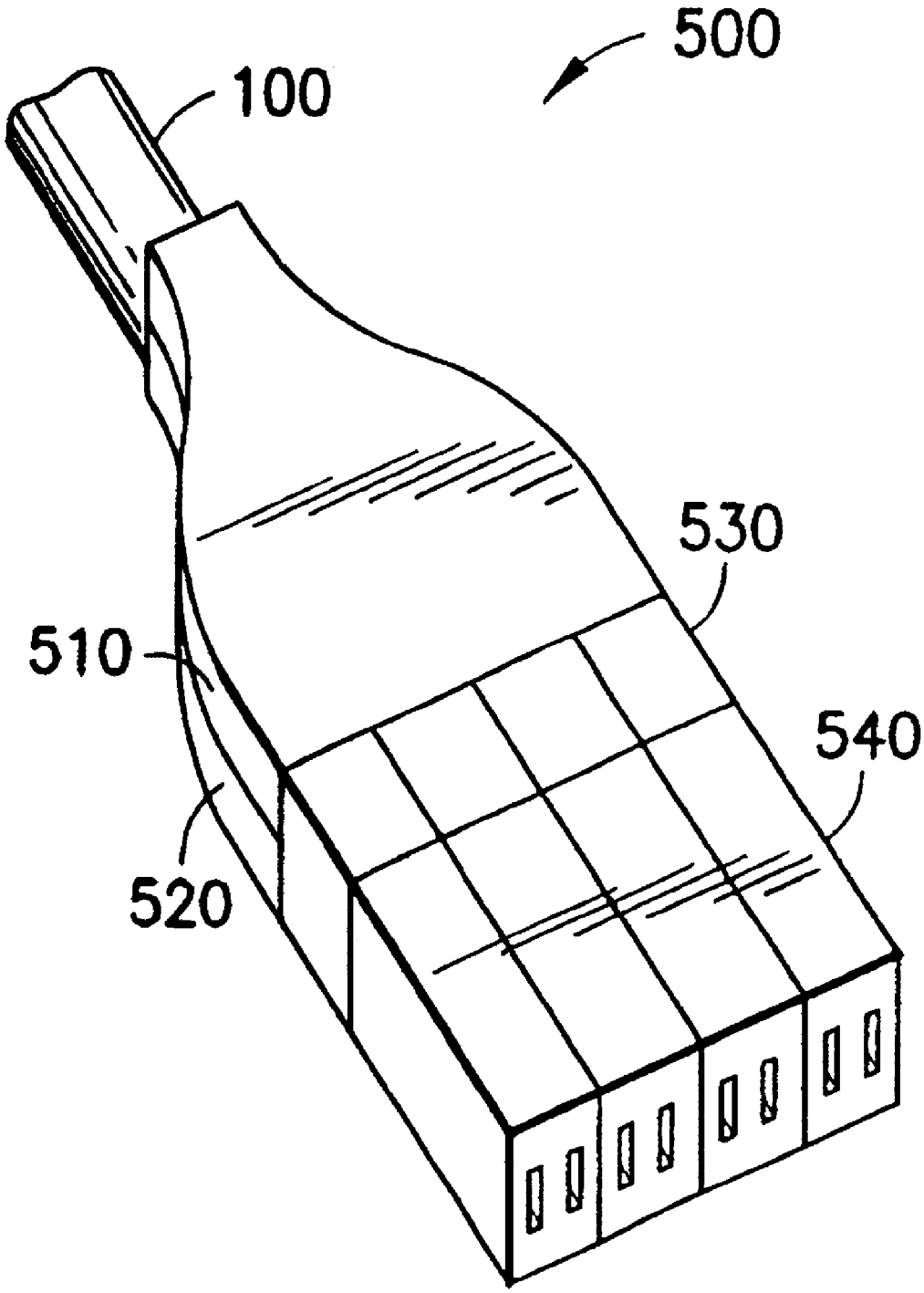
FIG. 16 is a view of the filly assembled modular type connector 500.

FIG. 16 is a view of the fully assembled modular type connector 500. While the two wires in a pair are not shielded from each other, each of the signal conducting paths of the wire pairs of the modular type connector 500 is shielded with a highly conductive material thereby reducing near end cross talk of the connector while providing flexibility in configuration and assembly. Ground for the conducting surface of the modular type connector 500 may be provided by a 110 type connecting block (not shown) upon connection with the modular type connector 500. Alternatively, an additional grounding may be provided independently.

Figure 17A:
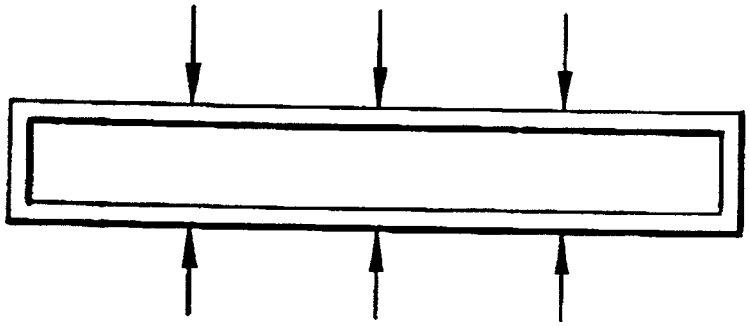
FIGS. 17A, 17B are cross sectional views showing another example of shielding the conducting paths of an electrical connector according to the invention.
Figure 17B:
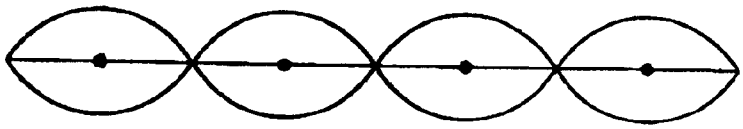

FIGS. 17A, 17B are cross sectional views showing another example of shielding the conducting paths of an electrical connector according to the invention. In FIG. 17A, a hollow tube forms the basis for the housing. The tube can either be a conductive or non-conductive material. If the tube is non-conductive, shielding will be applied to some or all of an internal or external surface of the tube. If the tube is conductive, it should be insulated for any wire ultimately contained therein. As shown in FIG. 17B, by applying a suitable force to the tube, separate units may be formed, such that at least one wire may be inserted into each unit. A spacer may be used to prevent the units from collapsing during formation and the wires can be inserted thereafter. Alternatively, the wires and/or insulation may be inserted into the hollow tube prior to the pressing. Each unit will be shielded as described above.

Figure 18A:
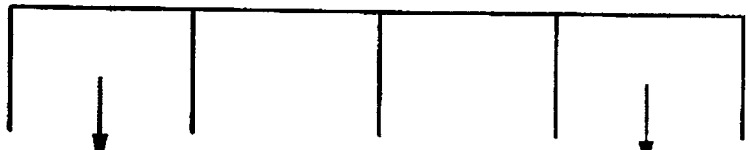
FIGS. 18A, 18B, 18C are cross sectional views showing yet another example of shielding the conducting paths of an electrical connector according to the invention.
Figure 18B:
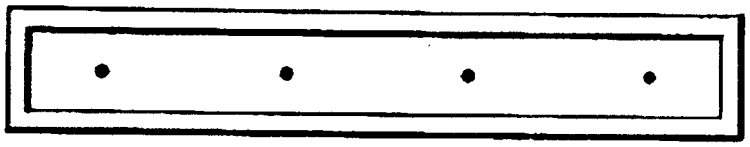
Figure 18C:
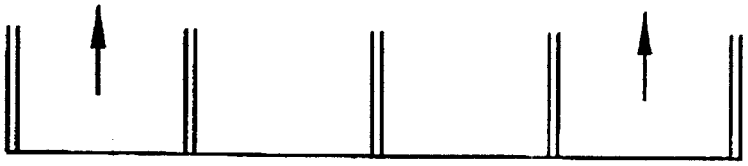

FIGS. 18A, 18B, 18C are cross sectional views showing yet another example of shielding the conducting paths of an electrical connector according to the invention. FIG. 18A is a male portion of a connector containing pieces of shielding conductors. FIG. 18B is a deformable non-conducting hollow tube with a cavity inside and FIG. 18C is a female portion of the connector containing pieces of shielding conductors. The male and female portions are brought together with the hollow tube in between such that the two mate with each other and the shielding conductors divide the tube into units, such that at least one wire may be inserted into each unit. Depending upon the particular implementations, the wires may be inserted in the tube prior to bringing the male and female portions together. Alternatively, a spacer may be used to prevent the units from collapsing during formation and the wires can be inserted thereafter.

Although illustrative embodiments incorporating the principles of the invention, and various modifications thereof, have been described in detail herein with reference to the accompanying drawings, it is to be understood that consisted with the above teachings, various changes and further modifications may be effected therein without departing from the scope or spirit of the invention as set forth in the appended claims.

What is claimed is:

1. A modularizable electrical connector component comprising:

a first housing constructed to accept at least one pair of wires of a cable having at least two twisted wire pairs;

a second housing substantially identical to the first housing constructed to receive the other pair of the at least two twisted wire pairs of the cable and configured to be attached to the first housing; and a conductive material disposed between the first and second housing thereby electrically separating the at least two twisted wire pairs so that when a signal propagates through one of the at least two twisted wire pairs and the conductive material is grounded, the conductive material will reduce near end cross talk caused by the signal in the other of the two twisted wire pairs.

2. The electrical connector of claim 1 further including a contact contained within the housing and connected to at least one of the wires of the at least two twisted wire pairs.

3. The electrical connector of claim 2, wherein the contact further includes a retainer to fix the contact inside the housing when assembled.

4. The electrical connector of claim 2, wherein the contact is constructed to provide strain relief for one of the wires of the at least two twisted wire pairs of the cable.

5. The electrical connector of claim 1, wherein the conductive material is at least one of aluminum, gold or silver.

6. A modularizable electrical connector for a cable having at least two twisted wire pairs comprising:

a first conductive contact configured to mount one of the at least two twisted wire pairs;

a second conductive contact configured to mount another of the at least two twisted wire pairs;

a first housing constructed to receive the first conductive contact; and a second housing configured to be attached to the first housing and constructed to receive the second conductive contact, wherein at least one of the first or second housing having a surface, at least a portion of which is coated by a conductive material, and wherein the conductive material is disposed between the first and second housing.

7. The electrical connector of claim 6, wherein each of the first contact and the second contact further includes a retainer to fix the contact inside the housing when assembled.

8. The electrical connector of claim 6, wherein each of the first contact and the second contact is constructed to provide strain relief for one of the wires of the cable.

9. The electrical connector of claim 6, wherein the conductive material is at least one of aluminum, gold or silver.

10. A method of assembling a modular type electrical connector having two or more unit connectors, the method comprising:

a) connecting one pair of wires of a cable having at least two twisted wire pairs to one of the unit connectors, the unit connectors having a surface, a portion of which is coated with a conductive material;

b) connecting another pair of wires of the at least two wire pairs to another unit connector;

c) attaching the unit connectors together such that the conductive material is disposed between the unit connectors so as to create a shield between the wire pair of the one unit connector and the other wire pair of the other unit connector.

11. The method of claim 10, wherein b) is repeated for each of the wire pairs of the cable.

12. The method of claim 10, further comprising coating the portion with the conductive material by at least one of plating, sputtering, vacuum evaporation, glueing or pasting of conductive ink.

13. The method of claim 10, wherein the attaching includes ultrasonic welding of one of the unit connectors to another of the unit connectors.

14. A cable assembly comprising:

a cable having at least two twisted wire pairs;

a first housing constructed to accept at least one twisted wire pair of the cable;

a second housing substantially identical to the first housing constructed to receive the other twisted wire pair of the at least two twisted wire pairs of the cable and configured to be attached to the first housing; and a conductive material electrically separating at least the two twisted wire pairs so that when a signal propagates through one of the at least two twisted wire pairs and the conductive material is grounded, the conductive material will reduce near end cross talk caused by the signal in the other of the at least two twisted wire pairs.

15. The electrical connector of claim 14, further including a contact contained within the housing and connected to at least one of the twisted wire pairs.

16. The electrical connector of claim 15, wherein the contact further includes a retainer to fix the contact inside the housing when assembled.

17. The electrical connector of claim 15, wherein the contact is constructed to provide strain relief for one of the wires of the cable.

18. The electrical connector of claim 14, wherein the conductive material is at least one of aluminum, gold or silver.

19. A modularizable device comprising:

a cable having at least two twisted wire pairs;

a first conductive contact constructed to mount one of the at least two twisted wire pairs of the cable and to provide strain relief for one of the at least two twisted wire pairs, and the first conductive contact including a retainer to fix the first conductive contact within a housing;

a second conductive contact substantially identical to the first conductive contact;

a first housing constructed to receive the first conductive contact; and a second housing configured to be attached to the first housing and substantially identical to the first housing, at least one of the first or second housings having a surface, at least a portion of which is coated by a conductive material, the conductive material being disposed so that when the first and second housings respectively contain the first and second contacts and the twisted wire pairs are mounted to the contacts and the first housing is placed adjacent to the second housing such that the conductive material is disposed therebetween, a signal propagating through one of the at least two twisted wire pairs, the conductive material will reduce near end cross talk caused by the signal in the other of the two twisted wire pairs when the conductive material is grounded.

20. A modularizable electrical connector component comprising:

a first housing constructed to accept only one wire of a cable having at least two wires;

a second housing substantially identical to the first housing constructed to receive the another wire of the at least two wires and configured to be attached to the first housing; and a conductive material coated on a portion of the first housing electrically separating the one wire from another wire of the at least two wires so that when a signal propagates through the one wire and the conductive material is grounded, the conductive material will reduce near end cross talk caused by the signal in the another wire of the at least two wires.

21. A cable assembly comprising:

a cable having at least two wires;

a first housing constructed to accept only one wire of the at least two wires of the cable;

a second housing substantially identical to the first housing constructed to receive the other wire of the at least two wires of the cable and configured to be attached to the first housing; and a conductive material coated on a portion of the first housing electrically separating the at least two wires of the cable so that when a signal propagates through the one wire and the conductive material is grounded, the conductive material will reduce near end cross talk caused by the signal in the other of the at least two wires.

* * * * *